US010191427B2

(12) United States Patent
Nagamatsu

(10) Patent No.: US 10,191,427 B2
(45) Date of Patent: Jan. 29, 2019

(54) IMAGE FORMING APPARATUS AND IMAGE FORMING CONTROL METHOD

(71) Applicant: Yuuji Nagamatsu, Tokyo (JP)

(72) Inventor: Yuuji Nagamatsu, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/827,244

(22) Filed: Nov. 30, 2017

(65) Prior Publication Data

US 2018/0217546 A1 Aug. 2, 2018

(30) Foreign Application Priority Data

Feb. 1, 2017 (JP) ..... 2017-017097

(51) Int. Cl.
*G03G 15/00* (2006.01)
*G03G 21/20* (2006.01)

(52) U.S. Cl.
CPC ..... *G03G 15/5045* (2013.01); *G03G 15/80* (2013.01); *G03G 21/203* (2013.01)

(58) Field of Classification Search
CPC ..... G03G 15/02; G03G 15/0266; G03G 15/0283; G03G 15/5045; G03G 15/80; G03G 21/203
See application file for complete search history.

(56) References Cited

U.S. PATENT DOCUMENTS

2007/0189788 A1* 8/2007 Hagiwara ..... G03G 15/0275 399/44
2009/0238591 A1* 9/2009 Watanabe ..... G03G 15/5037 399/51
2010/0086321 A1* 4/2010 Burry ..... G03G 15/0266 399/44
2012/0155899 A1* 6/2012 Watanabe ..... G03G 15/5058 399/49
2014/0294410 A1* 10/2014 Hayashi ..... G03G 21/203 399/44

(Continued)

FOREIGN PATENT DOCUMENTS

JP 2013-092586 5/2013
JP 2014-030336 2/2014

(Continued)

*Primary Examiner* — Ruifeng Pu
(74) *Attorney, Agent, or Firm* — Harness, Dickey & Pierce, P.L.C.

(57) ABSTRACT

An image forming apparatus includes a high-voltage power supply that supplies high-voltage electric power, a charging device that is charged by the electric power supplied from the high-voltage power supply, a photoconductor that carries an image to be formed on a recording medium, with the electric power supplied from the charging device, a temperature sensor disposed at a distant from the photoconductor that detects temperature inside the image forming apparatus, a humidity sensor disposed at a distant from the photoconductor that detects inside the image forming apparatus, and circuitry that outputs a signal for commanding an electric power value to the high-voltage power supply to cause the high-voltage power supply to supply the electric power with the electric power value, and controls supply of the electric power based on an electric power value feedback signal from the high-voltage power supply.

20 Claims, 9 Drawing Sheets

(56) References Cited

U.S. PATENT DOCUMENTS

| | | | | |
|---|---|---|---|---|
| 2015/0346652 | A1* | 12/2015 | Ohmura | G03G 15/1675 399/66 |
| 2017/0031260 | A1* | 2/2017 | Ikada | G03G 15/0266 |
| 2017/0097585 | A1* | 4/2017 | Kihara | G03G 15/55 |
| 2017/0255122 | A1* | 9/2017 | Minami | G03G 15/0266 |

FOREIGN PATENT DOCUMENTS

| | | |
|---|---|---|
| JP | 2015-148789 | 8/2015 |
| JP | 2016-051082 | 4/2016 |
| JP | 2016-153818 | 8/2016 |

* cited by examiner

IMAGE FORMING APPARATUS AND IMAGE FORMING CONTROL METHOD

CROSS-REFERENCE TO RELATED APPLICATION

This patent application is based on and claims priority pursuant to 35 U.S.C. § 119(a) to Japanese Patent Application No. 2017-017097, filed on Feb. 1, 2017 in the Japan Patent Office, the entire disclosure of which is hereby incorporated by reference herein.

BACKGROUND

Technical Field

The present invention relates to an image forming apparatus and an image forming control method.

Background Art

Conventionally, in image forming apparatuses such as multifunction peripherals (MFPs), in order to effectively control charging or prediction of the remaining life of a photoconductor, film thickness of the photoconductor is measured by detecting an output voltage value of a charging device or an output current value of the charging device. In this case, accuracy in measuring the film thickness improves by using temperature/humidity information around the photoconductor.

SUMMARY

Example embodiments of the present invention provide a novel image forming apparatus that includes a high-voltage power supply that supplies high-voltage electric power, a charging device that is charged by the electric power supplied from the high-voltage power supply, a photoconductor that carries an image to be formed on a recording medium, with the electric power supplied from the charging device, a temperature sensor disposed at a distant from the photoconductor that detects temperature inside the image forming apparatus, a humidity sensor disposed at a distant from the photoconductor that detects inside the image forming apparatus, and circuitry that outputs a signal for commanding an electric power value to the high-voltage power supply to cause the high-voltage power supply to supply the electric power with the electric power value, and controls supply of the electric power based on an electric power value feedback signal from the high-voltage power supply. The circuitry is configured to obtain a temperature difference between the detected temperature and an estimated temperature, obtain a humidity difference between the detected humidity and an estimated humidity, obtain at least one of a time it requires for the temperature difference becomes equal to or less than a predetermined value, and one of a time it requires for the humidity difference becomes equal to or less than a predetermined value, as a waiting time, store the waiting time in a memory, and detect film thickness on a surface of the photoconductor after the target waiting time elapses.

Further example embodiments of the present invention provide an information processing method and a non-transitory recording medium storing an information processing program.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

Figure 1:
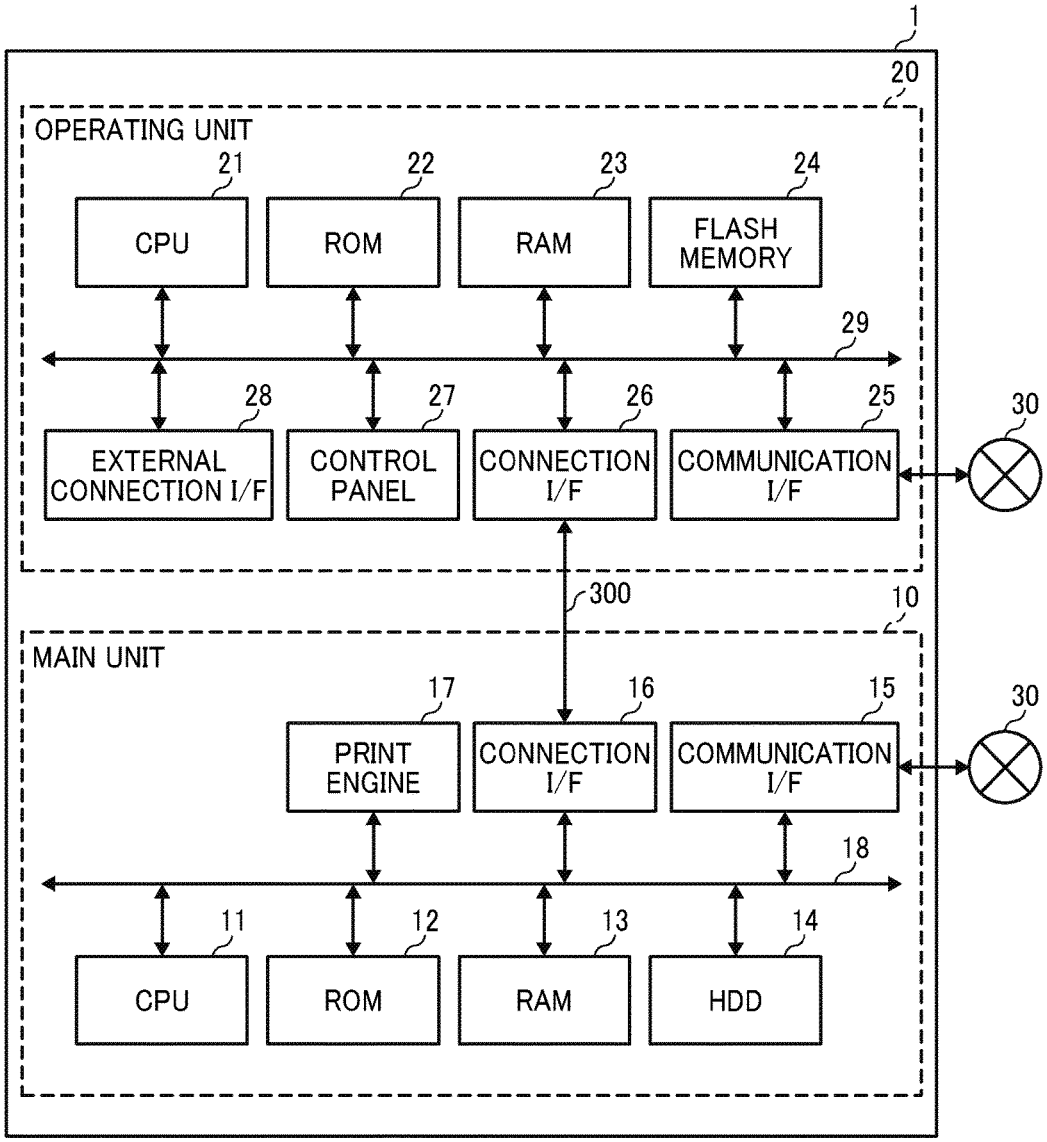
FIG. 1 is a block diagram illustrating a schematic configuration of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

A more complete appreciation of the disclosure and many of the attendant advantages thereof will be readily obtained as the same becomes better understood by reference to the following detailed description when considered in conjunction with the accompanying drawings.

Exemplary embodiments of this disclosure are now described below with reference to the accompanying drawings.

FIG. 1 is a block diagram illustrating a schematic configuration of an image forming apparatus in this embodiment.

With reference to FIG. 1, the image forming apparatus 1 is a multifunction peripheral (MFP) that has multiple functions such as print function, scan function (scanner function), copy function, and facsimile function etc.

The image forming apparatus 1 includes a main unit 10 and an operating unit 20, each manufactured independently. In the image forming apparatus 1, the operating unit 20 is mounted onto the main unit 10, and the main unit 10 and the operating unit 20 are connected with each other via an interface cable 300. The main unit 10 includes a central processing unit (CPU) 11, a read only memory (ROM) 12, a random access memory (RAM) 13, a hard disk drive (HDD) 14, a communication interface (I/F) 15, a connection I/F 16, and a print engine 17, and those components are connected with each other via a bus 18. The operating unit 20 includes a CPU 21, a ROM 22, a RAM 23, a flash memory 24 as a nonvolatile memory, a communication I/F 25, a connection I/F 26, a control panel 27, and an external connection I/F 28, and those components are connected with each other via a bus 29.

Among the components described above, the connection I/F 16 is connected to the connection I/F 26 via an interface cable 300 to connect the main unit 10 to the operating unit 20 with each other. In addition, the communication I/F 15 and the communication I/F 25 are respectively connected to a network 30 such as a local area network (LAN) etc. Furthermore, as described later, the RAM 13 and the RAM 23 store model type values corresponding to initializing operations that are different from each other. Application software is installed by performing the initializing operation. Here, if the connection I/F 16 and the connection I/F 26 are compatible with a wireless communication, instead of connecting the communication I/F 16 and the connection I/F 26 via the interface cable 300, the operating unit 20 may be disconnected from the main unit 10 to be separated from the main unit 10.

The CPU 11 in the main unit 10 is capable of determining whether or not the model type exists, and processing information in performing operation of storing a model type value corresponding to the content of each of different initializing operations. In addition, in mounting the operating unit 20, after reading a content stored in the RAM 13 as a memory, the CPU 11 in the main unit 10 reports to the operating unit 20 via the connection I/F 16 and the interface cable 300 information on whether or not the model type exists and the model type value if the model type exists. Furthermore, in performing the initializing operation before shipping, the CPU 11 in the main unit 10 stores the model type value in the RAM 13. Subsequently, after mounting the operating unit 20, in booting up, the CPU 11 in the main unit 10 reports the model type value to the operating unit 20. In this case, based on the model type value reported from the main unit 10 via the connection I/F 16 and the interface cable 300, the CPU 21 in the operating unit 20 performs the initializing operation.

Otherwise, after receiving notification indicating that no model type exists if the RAM 13 in the main unit 10 is replaced because the RAM 13 as the memory fails to operate properly etc., the CPU 21 in the operating unit 20 reports the model type value stored in the RAM 23 as its own memory to the main unit 10. Here, in this case, the model type value reported from the operating unit 20 via the connection I/F 26 and the interface cable 300 is stored in the replaced RAM 13 by performing a storing operation in the information processing function of the CPU 11 in the main unit 10.

With reference to the model type value reported from the main unit 10, the CPU 21 in the operating unit 20 switches and performs the content of the initializing operation in accordance with the reported model type value. Furthermore, as the content of the initializing operation, the CPU 21 in the operating unit 20 keeps only application software that is required for the type of the main unit 10, and deletes unnecessary application software. In addition, if the model type value is not stored in the RAM 23 as the memory due to replacement of the part etc., after performing the initializing operation in accordance with the model type value reported from the main unit 10, the CPU 21 in the operating unit 20 stores the model type value in the RAM 23 to be referred to by the image forming apparatus 1.

Here, in the image forming apparatus 1 in FIG. 1, the operating unit 20 is mounted on the main unit 10. However, the present disclosure includes a configuration in which the operating unit 20 before being mounted and the main unit 10 implements as an image forming system. That is, since the image forming apparatus 1 is an example of an information processing apparatus, the image forming system is an example of an information processing system.

Figure 2:
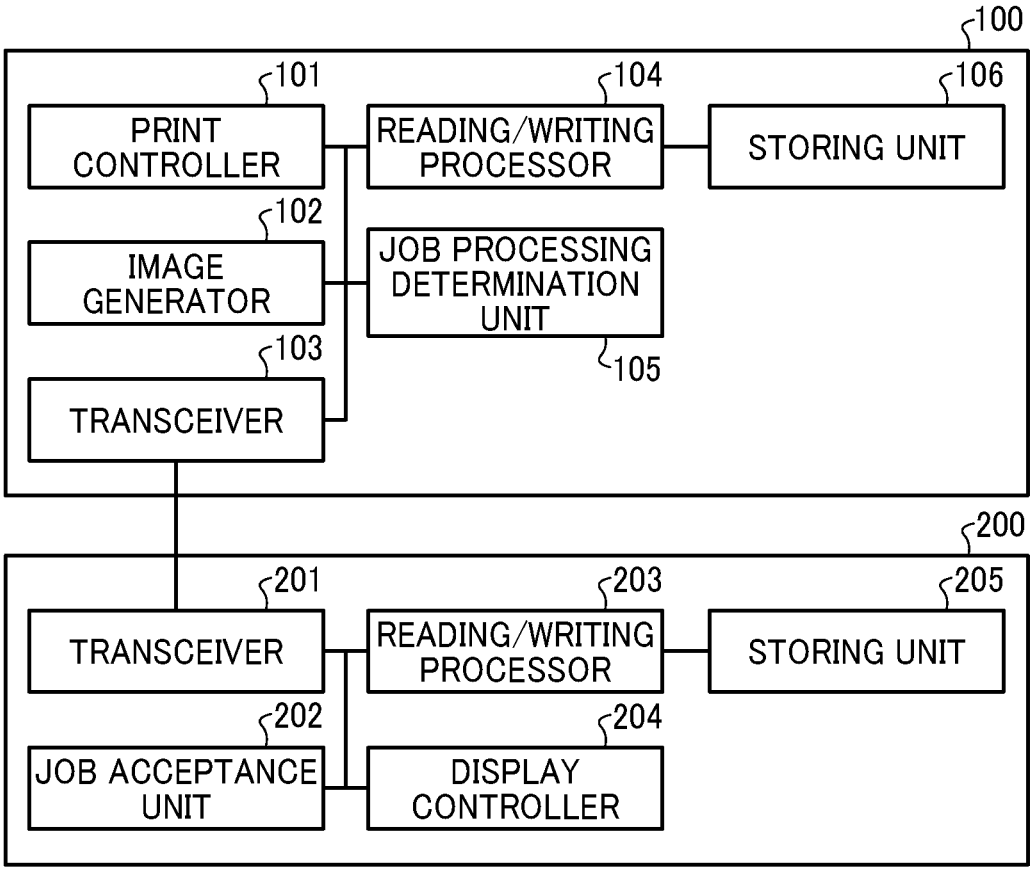
FIG. 2 is a diagram illustrating functional blocks of the image forming apparatus in FIG. 1 as an embodiment of the present invention.

FIG. 2 is a functional block diagram of the image forming apparatus 1 described above according to the present example embodiment.

With reference to FIG. 2, on the functional blocks, the image forming apparatus 1 includes a controller 100 in the main unit 10 and a controller 200 in the operating unit 20 connected with each other. The controller 100 in the main unit 10 includes a print controller 101, an image generator 102, a transceiver (transmitter and receiver) 103, a reading/writing processor 104, a job processing determination unit (determining unit) 105, and a storing unit 106.

The transceiver 103 in the controller 100 is implemented by using the connection I/F 16 in FIG. 1 and exchanges various data (information) with the operating unit 20 using USB.

The image generator 102 in the controller 100 is implemented by commands from the CPU 11 in FIG. 1, a program for the controller stored in the ROM 12, and the RAM 13 and expands data in a user job to draw an image in the RAM 13.

The reading/writing processor 104 in the controller 100 is implemented by commands from the CPU 11 in FIG. 1 according to a program for the controller stored in the ROM 12. The reading/writing processor 104 performs processing to store various types of data in the storing unit 106 and read various types of data stored in the storing unit 106.

The print controller 101 in the controller 100 is implemented by commands from the CPU 11 in FIG. 1 according to a program for the controller stored in the ROM 12, the print engine 17, and the connection I/F 16. By controlling the print engine 17, the print controller 101 transfers the image written in the RAM 13 by the image generator 102 onto paper to print the image.

The job processing determination unit 105 in the controller 100 is implemented by commands from the CPU 11 in FIG. 1 according to a program for the controller stored in the ROM 12, and the connection I/F 16. In booting up the controller 100, the job processing determination unit 105 acquires a tray information management table stored in the storing unit 106. In accordance with a request to process job transferred by the operating unit 20, the job processing determination unit 105 extracts print setting information associated with a tray number designated by the request to process job from the tray information management table. Along with information requesting to process job, print setting information such as paper size and paper orientation etc. and print editing conditions such as duplex print or simplex print and combining pages etc. are added to the print condition information in the request to process job. The job processing determination unit 105 determines whether or not the paper size and paper orientation in the print setting information extracted from the tray information management table corresponds to the paper size and paper orientation added to the request to process job. If so, the job processing determination unit 105 requests the print controller 101 to perform processing in accordance with the print setting information in the request to process job. If not, the job processing determination unit 105 determines to cancel the job requested by the request to process job. In case of determining to cancel the job, the job processing determination unit 105 transfers information indicating that the job is to be canceled to the controller 200 via the transceiver 103.

The controller 200 in the operating unit 20 includes a data transceiver (transmitter and receiver) 201, a job acceptance unit 202, a reading/writing processor 203, a display controller 204, and a storing unit 205. Those components described above are functions or units implemented by operating some of the hardware components illustrated in FIG. 1 under control of the CPU 21 in accordance with programs stored in the ROM 22. In addition, the controller 200 includes the storing unit 205 implemented by the flash memory 24 as the nonvolatile memory in FIG. 1. The storing unit 205 stores the tray information management table.

The transceiver 201 in the controller 200 is implemented by the connection I/F 26 in FIG. 1 and exchanges various data (information) with the controller 100 using USB communication.

The reading/writing processor 203 in the controller 200 is implemented by commands from the CPU 21 in FIG. 1. The reading/writing processor 203 performs processing to store various types of data in the storing unit 205 and read various types of data stored in the storing unit 205.

The display controller 204 in the controller 200 is implemented by commands from the CPU 21 in FIG. 1 according to a program for the operating unit stored in the ROM 22 and controls displaying an image on a screen of a display device (display unit). In addition, the display controller 204 inputs operating information generated by a user operation of pressing down items displayed on the screen of the display device into the job acceptance unit 202. For example, the display controller 204 inputs the request to process job, which is generated by a user operation of requesting to process a job to print etc. into the job acceptance unit 202. Based on the tray information management table stored in the storing unit 205, the user may input the request to process job. Subsequently, as a response to the request to process job, if information indicating that the job processing is canceled is input from the job acceptance unit 202, the display controller 204 displays a message indicating that the job is canceled on the screen of the display device.

The job acceptance unit 202 in the controller 200 is implemented by commands from the CPU 21 in FIG. 1 according to a program for the operating unit stored in the ROM 22. If the request to process job is input from the display controller 204, the job acceptance unit 202 transfers the request to process job to the controller 100 via the transceiver 201. Subsequently, as a response to the request to process job, if information indicating that the job processing transferred by the controller 100 is canceled is input from the transceiver 201, the job acceptance unit 202 requests the display controller 204 to display the message indicating that the job is canceled on the screen of the display device.

The program executed by the image forming apparatus 1 described above such as the program for the controller and the program for the operating unit may be provided by being stored in a computer readable, recording medium, such as a compact disc read only memory (CD-ROM), a flexible disk (FD), a compact disc recordable (CD-R), a digital versatile disc (DVD), and a Universal Serial Bus (USB) memory etc., in a file format installable or executable. Otherwise, the programs can be provided or distributed via the network such as the Internet etc., and it is also possible that various programs are stored preliminarily in the nonvolatile storage medium (recording medium) such as the ROM etc.

Figure 3:
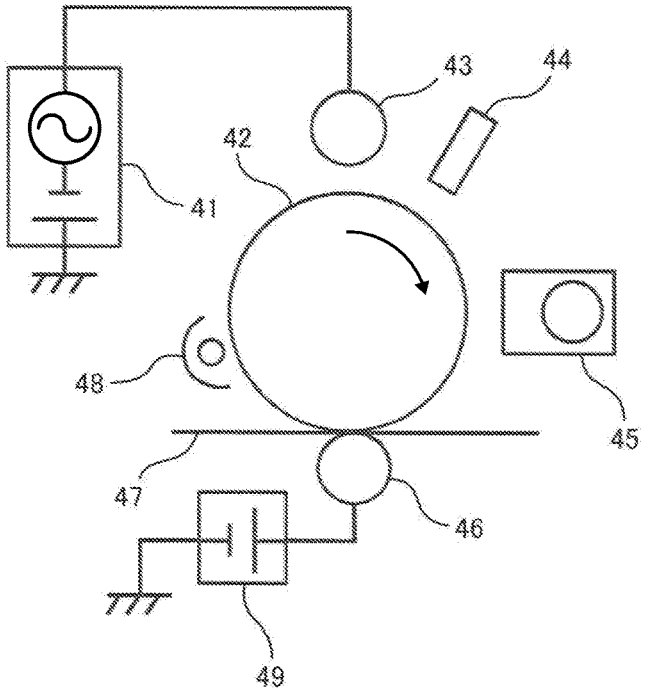
FIG. 3 is a diagram illustrating a schematic configuration of a transfer cleaning mechanism used for indirect transfer as a substantial part in forming an image in an electrophotographic method performed by the image forming apparatus in FIG. 1.

FIG. 3 is a diagram illustrating a schematic configuration of a transfer cleaning mechanism used for indirect transfer in forming an image (image formation process) using the electrophotographic (electrophotography) method, performed by the image forming apparatus in FIG. 1 described above.

With reference to FIG. 3, the transfer cleaning mechanism includes a high-voltage power supply 41 that supplies high-voltage electric power (high-voltage power) for charging, a charging roller 43 that is charged by supplying power, and a photoconductor 42 as an image carrier to be charged via the charging roller 43. In addition, the transfer cleaning mechanism includes an exposure unit 44 that forms an electrostatic latent image on a surface of the photoconductor 42 by exposing the photoconductor 42 in accordance with the image signal, a developing unit 45 that develops a toner image on the surface of the photoconductor 42, and a primary-transfer, high-voltage power supply 49 that supplies high-voltage power to be used for primary transfer. Furthermore, a primary transfer roller 46 that applies high voltage by supplying high-voltage power by the primary-transfer, high-voltage power supply 49, an intermediate belt 47 carrying the toner image transferred from the photoconductor 42, and an electric charge removing unit (diselectrifier)

48 that removes electric charge from the surface of the photoconductor 42, are respectively provided.

In the transfer cleaning mechanism, high voltage generated by supplying high-voltage power by the high-voltage power supply 41 is applied to the charging roller 43 to uniformly charge the surface of the photoconductor 42. Subsequently, the exposure unit 44 exposes in accordance with the image signal to form the electrostatic latent image on the surface of the photoconductor 42. After that, the developing unit 45 develops the latent image into the toner image on the surface of the photoconductor 42. Furthermore, by applying high voltage generated by supplying high-voltage power by the primary-transfer, high-voltage power supply 49 to the primary transfer roller 46, the toner image on the surface of the photoconductor 42 is transferred to the intermediate belt 47 (primary transfer). The toner image transferred to the intermediate belt 47 is transferred to the recording medium by a secondary transfer unit (secondary transfer), and an image is formed on the recording medium by heating and fixing the secondary transfer image by a fixing unit. Here, similarly in the below description, the recording medium is generally paper. However, the recording medium may be other media such as coat paper, label paper, overhead projector sheet, film, and flexible thin board etc. If the diselectrifier 48 is included, the photoconductor 42 is charged after diselectrifying the surface of the photoconductor 42 by the diselectrifier 48. In case of printing color images, four similar transfer cleaning mechanisms are laid out in parallel, and the toner image is transferred primarily to the intermediate belt 47 for each color and fixed after being transferred secondary. Here, in the transfer cleaning mechanism in FIG. 3, a noncontact charging type configuration that the high-voltage power supply 41 is separated from the photoconductor 42 is illustrated. However, a contact charging type that the high-voltage power supply 41 contacts the photoconductor 42 may be applied.

Figure 4:
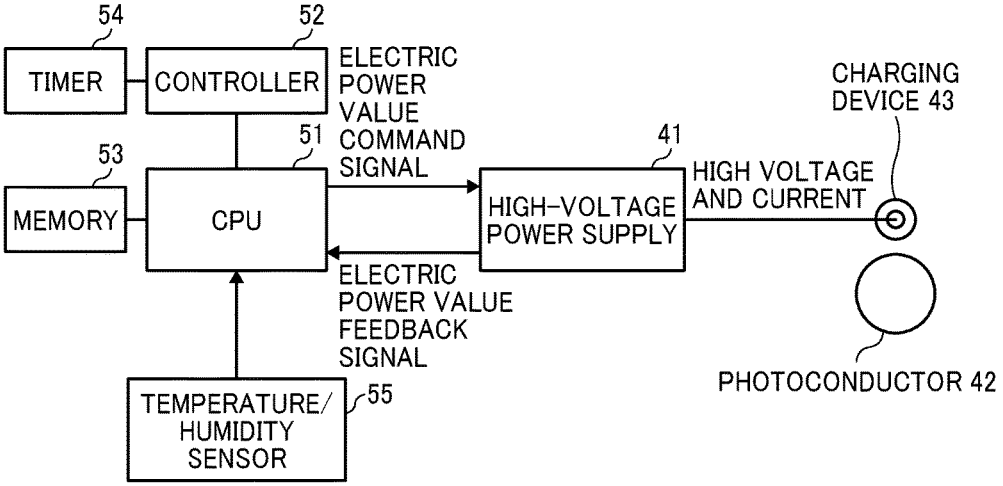
FIG. 4 is a schematic block diagram illustrating a controlling circuit that controls supplying electric power to a high-voltage power supply in the transfer cleaning mechanism in FIG. 3.

FIG. 4 is a schematic block diagram illustrating a controlling circuit that controls supplying electric power to the high-voltage power supply 41 in the transfer cleaning mechanism described above.

With reference to FIG. 4, the controlling circuit regards the photoconductor 42 as a target to be charged and regards the high-voltage power supply 41 that supplies power to the charging roller 43 that high voltage is applied as a target to be controlled. More specifically, the controlling circuit includes a CPU 51 that outputs a signal for commanding a electrical power value for supplying power to the high-voltage power supply 41 and controls supplying power and detects film thickness on the surface of the photoconductor 42 based on the electric power value feedback signal received from the high-voltage power supply 41. The electric power value feedback signal described above may be a feedback signal of an output voltage value of the power supplied by the high-voltage power supply 41 or a feedback signal of an output current value of the power supplied by the high-voltage power supply 41. In addition, the controlling circuit includes a timer 54 that counts elapsed time and a controller 52 connected to the timer 54 and the CPU 51 that generates a control command value for the CPU 51 and outputs the generated control command value along with a count value counted by the timer 54. Here, the timer 54 and the controller 52 described above are supplied electric power by another power supply so that the timer 54 and the controller 52 may operate even if the main power of the apparatus is turned off. Furthermore, the controlling circuit includes a memory 53 connected to the CPU 51 that stores waiting time as a target calculated based on the elapsed time counted by the timer 54 in a format of a table. In addition, the controlling circuit includes a temperature/humidity sensor 55 connected to the CPU 51 and detects temperature and humidity located at a location away from the photoconductor 42 and the charging roller 43 in the apparatus body.

Among the components described above, regarding the temperature/humidity sensor 55, a temperature sensor that detects temperature in the apparatus may be disposed at a location away from the photoconductor 42, and a humidity sensor that detects humidity in the apparatus may be disposed away from the photoconductor 42 and the charging roller 43. In addition, the controller 52 and the CPU 51 may function as a controlling unit that cooperates to calculate waiting time, used to determine a time when the thickness on the surface of the photoconductor 42 is calculated. The waiting time indicates, after the elapsed time is acquired from the timer 54, a time that difference between the temperature and humidity in the apparatus detected by the temperature/humidity sensor 55 and temperature and humidity around the photoconductor 42, presumed preliminarily, becomes equal to or less than a predetermined value. The predetermined value is a value previously determined to ensure accuracy detecting the film thickness on the surface of the photoconductor 42. If the temperature sensor is located separately from the humidity sensor, at least either one of difference between temperature in the apparatus and temperature presumed preliminarily around the photoconductor 42 and difference between humidity in the apparatus and humidity presumed preliminarily around the photoconductor 42 is used for calculating the waiting time.

Here, in case of the background image forming apparatus, since the way of controlling forming images is changed depending on the temperature and humidity at environment where the apparatus is located, the image forming apparatus includes at least one or more temperature/humidity sensors. However, around the photoconductor, modules such as a charging module and a transfer module etc. are laid out densely. Therefore, it is difficult to allocate space to locate various sensors around the photoconductor. Consequently, in order to measure temperature and humidity around the charging devices indicating the photoconductor and the charging roller, it is required to ensure space to locate the various sensors by enlarging the layout etc. In this case, it becomes a problem that not only the cost rises but also it is required to enlarge the whole size of the image forming apparatus to ensure the space to locate the various sensors.

In view of this, the present inventors have found out that, since the temperature/humidity information is used other than the area around the charging devices in the image forming apparatus, temperature/humidity information detected by the temperature/humidity sensor located at an area away from the surroundings of the charging devices can be used, as the temperature and humidity around the charging devices.

Hereinafter, relationship between the detection value of temperature/humidity detected by the temperature/humidity sensor 55 inside the image forming apparatus 1 during when the apparatus operates to perform such as printing etc. and change of temperature/humidity around the charging devices is described below. As the apparatus operates to perform such as printing etc., working devices inside the image forming apparatus 1 get warm, and unevenness of temperature/humidity occurs at the place where the apparatus is located or inside the apparatus. Therefore, it is not always true that the temperature/humidity detected by the temperature/humidity sensor 55 corresponds to temperature/humidity detected away from the temperature/humidity sensor 55. However, after the apparatus is left for a predetermined period of time, the heat is radiated, and difference between temperature/humidity detected by the temperature/humidity sensor 55 and temperature/humidity around the charging devices in the image forming apparatus 1 falls within a predetermined value range. As a result, it is possible to calculate the waiting time, which is a time required for the difference between the temperature/humidity detected by the temperature/humidity sensor 55 inside the image forming apparatus 1 and the temperature/humidity around the charging devices to fall within the predetermined value range, and regard the calculated waiting time as the time to leave the apparatus. After the waiting time as the target elapses, the film thickness on the surface of the photoconductor 42 can be detected with a high degree of accuracy.

Figure 5:
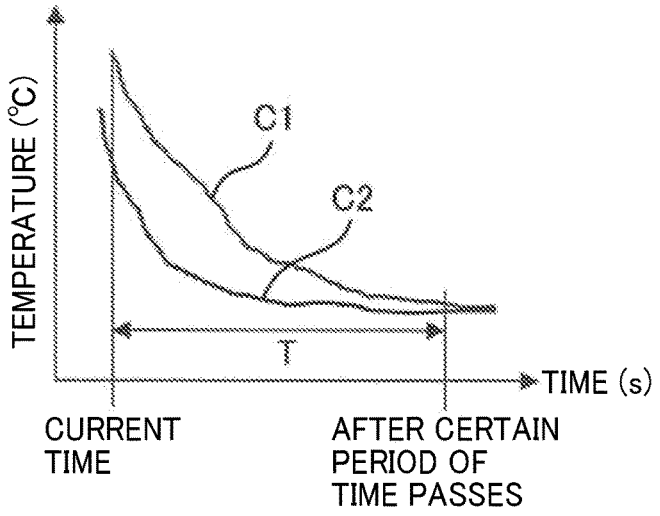
FIG. 5 is a characteristic chart illustrating a relationship between time and temperature due to difference of places where temperature sensors are located applied to the image forming apparatus in FIG. 1.

FIG. 5 is a characteristic chart illustrating a relationship between time (s) and temperature (° C.), which changes due to difference in places where temperature sensors are located. The temperature sensors are to be applied to the image forming apparatus in FIG. 1.

With reference to FIG. 5, characteristic (curve) C1 indicates a transition of temperature variations detected by the temperature sensor located around the charging devices from current time to time when a predetermined period of time T elapses, and characteristic (curve) C2 indicates a transition of temperature variations detected by the temperature sensor located away from the charging devices from current time to time when the predetermined period of time T elapses. In comparison with these characteristics, in the characteristic C1, higher temperature is maintained before the predetermined period of time T elapses compared to the characteristic C2. However, as time passes, difference between the two temperatures decreases, and the two temperatures become almost equal at the predetermined period of time T. Here, the elapsed time it takes for the difference to fall within the predetermined value range described above, that is, the waiting time for the predetermined period of time T is calculated, and the waiting time is regarded as the waiting time. Consequently, by detecting the film thickness on the surface of the photoconductor 42 after the waiting time as the target elapses, the film thickness is detected with a high degree of accuracy. However, if the apparatus operates to perform such as printing etc. during the calculated waiting time, since accuracy of detecting the film thickness on the surface of the photoconductor 42 is affected as it stands, it is required to cope with the issue separately.

Figure 6:
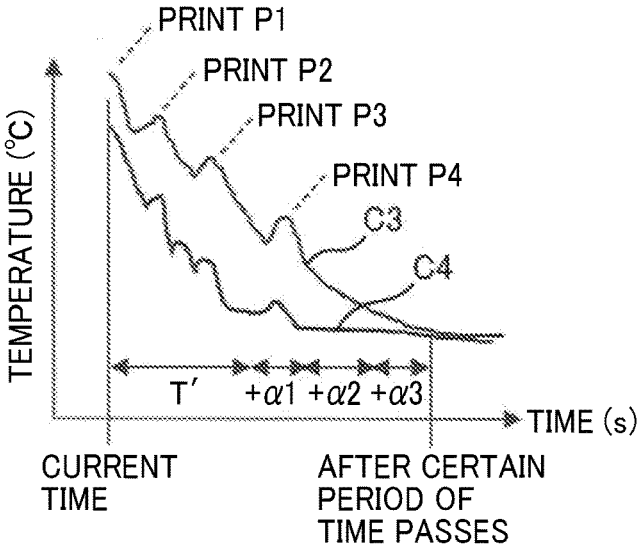
FIG. 6 is a characteristic chart illustrating a relationship between time and temperature additional time to waiting time for each operation of the image forming apparatus in FIG. 1.

FIG. 6 is a characteristic chart illustrating a relationship between time (s) and temperature (° C.), when additional time is added to the waiting time for each operation of the image forming apparatus 1.

With reference to FIG. 6, just like the description above, characteristic C3 indicates a transition of temperature variations detected by the temperature sensor located around the charging devices from current time to time when a predetermined period of time T elapses, and characteristic C4 indicates a transition of temperature variations detected by the temperature sensor located away from the charging devices from current time to time when the predetermined period of time T elapses. FIG. 6 illustrates an example of extending waiting time T' in case of performing machine operations such as printing etc., i.e., second printing P2 and third printing P3, during the waiting time T' after performing first printing P1 is illustrated. That is, if machine operation such as printing is performed during the waiting time T' and internal temperature of the image forming apparatus 1 rises, in consideration of temperature rise estimated from the machine operation, additional time+a1, +a2, and +a3 are added to the waiting time T' for each machine operation. As a result, even if the apparatus is used in various ways, the waiting time for the predetermined period of time is configured appropriately. In FIG. 6, for example, in case of the waiting time T' in the first printing P1, the additional time+a1 is added after the second printing P2, the additional time+a2 is added after the third printing P3, and the additional time+a3 is added after the fourth printing P4 performed during the additional time+a1.

In the image forming apparatus 1 in this embodiment, the CPU 51 calculates a waiting time, which is a time period it takes for the difference between the temperature/humidity detected by the temperature/humidity sensor 55 located separately from the charging devices and the temperature/humidity around the charging devices estimated preliminarily, to be equal to or less than a predetermined value, thus not affecting the detection of the film thickness on the surface of the photoconductor 42. Here, the charging devices described above correspond to the photoconductor 42 and the charging roller 43 as described before. In addition, as described with reference to FIG. 5, the mutual difference between the temperature and humidity similarly decreases such that their values become close to each other as the time counted by the timer 54 elapses. The predetermined value corresponds to the time difference value, which indicates a time required to ensure accuracy of detecting the film thickness on the surface of the photoconductor 42. Therefore, this time can be regarded as the waiting time. That is, the CPU 51 acquires the elapsed time from the timer 54 via the controller 52 and calculates the waiting time equal to or less than the predetermined value required for the accuracy of detecting the film thickness on the surface of the photoconductor 42 based on the electric power value feedback signal from the high-voltage power supply 41 that the electric power command signal is transferred. Subsequently, the calculated waiting time is stored in the memory 53 as the waiting time as the target, and the CPU 51 detects the film thickness on the surface of the photoconductor 42 under the condition after the waiting time elapses. As a result, even if the temperature/humidity sensor 55 is separated from the photoconductor 42, by configuring the appropriate waiting time, the film thickness can be detected on the surface of the photoconductor 42 with a high degree of accuracy at low cost, while saving space. In addition, instead of adding the temperature/humidity sensor 55 around the charging devices, the film thickness can be detected with a high degree of accuracy.

Here, the accuracy required to detect the film thickness on the surface of the photoconductor 42 varies in accordance with the detection content. For example, in case of detecting remaining life precisely for the photoconductor 42 with the film thickness near to the lifetime, in order to exclude error in measuring temperature/humidity as much as possible, it is desirable to keep error in actual measurement values of the temperature/humidity sensor 55 within ±0.01%. In case of spotting a trend of lifetime phenomenon while the lifetime still remains, it is desirable to keep error within ±0.02%. Furthermore, if accuracy of the electric power value feedback signal for detecting lifetime from the high-voltage power supply 41 corresponds to 3%, in order to keep total detection accuracy equal to or less than 5%, for example, the error is configured to 0.15% so that the detection accuracy becomes equal to or less than 2%. As described above, the error is determined depending on the accuracy of the film thickness to be detected. The time required until the difference between the temperature/humidity detected by the temperature/humidity sensor 55 and the temperature/humidity around the charging devices becomes equal to or less than the predetermined value may be determined in various ways such as measurement in experiment, simulation, and theoretical calculation etc. Here, all of the waiting time as the target are configured by measuring values experimentally. As described below, the waiting time as the target may be modified in accordance with physical characteristics and elements.

Table 1 describes most appropriate additional waiting time per sheet under various conditions such as monochrome, color, standard paper (plain paper), and thick paper etc. derived experimentally in accordance with the machine operations described with reference to FIG. 6.

TABLE 1

| | | Additional waiting time per sheet |
|---|---|---|
| Monochrome | Standard paper | 8 minutes |
| | Thick paper | 11.5 minutes |
| Color | Standard paper | 12.1 minutes |
| | Thick paper | 15.4 minutes |

With reference to Table 1, the additional waiting time in color printing becomes longer compared to monochrome printing. Furthermore, the additional waiting time in thick paper becomes further longer compared to the additional waiting time in standard paper.

Generally, heat attenuation of material occurs due to heat conduction and heat radiation. Especially, heat conduction is related to heat conductivity specific to material. In case of material objects whose material is the same, temperature change may vary due to large cubic content etc. (i.e., thermal capacity is large) and large surface area (i.e., amount of heat radiation per unit time is large) etc.

Figure 7:
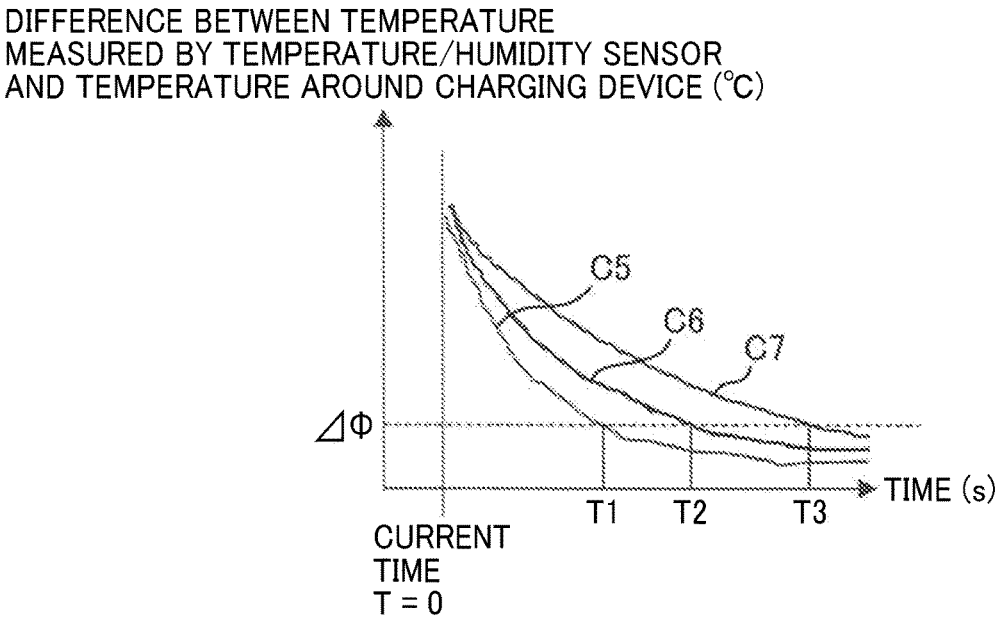
FIG. 7 is a diagram illustrating change of characteristic when material whose thermal conductivity is different is used for a charging device in the controlling circuit in FIG. 4 in relationship to difference between temperature measured by a temperature/humidity sensor and temperature around the charging device as time passes.

FIG. 7 is a diagram illustrating change of characteristic when material whose thermal conductivity is different is used for a charging device in the controlling circuit in FIG. 4 in relationship to difference between temperature (OC) measured by a temperature/humidity sensor 55 and temperature around the charging device as time (s) passes. Here, in FIG. 7, time until difference between temperature detected by the temperature/humidity sensor 55 and temperature around the charging devices becomes equal to or less than a target value $\Delta\varphi$ is considered as the waiting time as the target. For example, if the difference between the temperature detected by the temperature/humidity sensor 55 and the temperature around the charging devices falls within ±0.2° C. and error in detecting film thickness on the surface of the photoconductor 42 falls within 3%, in case the detection accuracy does not matter, $\varphi$ is configured as ±0.2.

With reference to FIG. 7, here, variation of the difference between the temperature detected by the temperature/humidity sensor 55 and the temperature around the charging devices is illustrated, and it is stopped to supply power from current time T=0 and the apparatus is cooled down naturally. More specifically, characteristic C5 corresponds to a case that heat conductivity of the charging devices is high, and the waiting time as the target T1 is shorter. In addition, characteristic C6 corresponds to a case that heat conductivity of the charging devices is medium, and the waiting time as the target T2 is longer than the waiting time as target T1 that heat conductivity is high. Furthermore, characteristic C7 corresponds to a case that heat conductivity is low, and the waiting time as the target T3 is longer than the waiting time as target T2 that heat conductivity is medium. As a result, the CPU 51 as the controlling unit may switch the waiting time T1, T2, and T3 in accordance with the heat conductivity of material of the charging device (i.e., the charging roller 43 or the photoconductor 42) to configure the most appropriate waiting time as target.

Table 2 illustrates waiting time after printing one sheet in case of using the charging devices whose heat conductivity of material is different in four types.

TABLE 2

| Sample name | Heat conductivity [W/(m · K)] | Waiting time after printing one sheet |
|---|---|---|
| Material A | 0.236 | 8.5 minutes |
| Material B | 0.381 | 7.9 minutes |
| Material C | 0.42 | 7.4 minutes |
| Material D | 0.475 | 6.7 minutes |

With reference to Table 2, the waiting time after printing one sheet becomes shorter in order of material D whose heat conductivity is the highest, material C, material B, and material A. In other words, the waiting time after printing one sheet becomes longer in order of material A whose heat conductivity is the lowest, material B, material C, and material D. However, while the heat conductivity of material is the same, if thermal capacity is different, held amount of heat is different, and characteristic of temperature attenuation varies. Therefore, the CPU 51 as the controlling unit may just switch the waiting time as target in accordance with the difference in material of the charging devices. This results in configuring time appropriately.

Table 3 illustrates waiting time after printing one sheet in case of using the charging devices whose heat conductivity of material is the same but thermal capacity of material is different.

TABLE 3

| Sample name | Thermal capacity [J/K] | Waiting time after printing one sheet |
|---|---|---|
| Material α | 0.41 | 12.7 minutes |
| Material β | 0.443 | 15.8 minutes |
| Material γ | 0.513 | 23.1 minutes |
| Material δ | 0.548 | 26.4 minutes |

With reference to Table 3, the waiting time after printing one sheet becomes longer in order of material δ whose thermal capacity is the highest, material γ, material β, and material α In other words, the waiting time after printing one sheet becomes shorter in order of material α whose thermal capacity is the lowest, material β, material γ, and material δ. Therefore, the CPU 51 as the controlling unit may just switch the waiting time as target in accordance with the difference in thermal capacity of the charging devices. This results in configuring time appropriately. However, while the heat conductivity and the thermal capacity are the same, if a surface area that touches air and other material is different, amount of heat lost per unit of time is different and characteristic of temperature attenuation varies.

Table 4 illustrates waiting time after printing one sheet in case of using the charging devices whose heat conductivity and thermal capacity of material are the same but the surface area of material is different.

TABLE 4

| Sample name | Surface area [$cm^2$] | Waiting time after printing one sheet |
|---|---|---|
| Material 1) | 106.7 | 10.4 minutes |
| Material 2) | 125.4 | 13.1 minutes |
| Material 3) | 134.2 | 15.8 minutes |

With reference to Table 4, the waiting time after printing one sheet becomes longer in order of material 3) whose surface are is the largest, material 2), and material 1). In other words, the waiting time after printing one sheet becomes shorter in order of material 1) whose surface are is the smallest, material 2), and material 3). Therefore, the CPU 51 as the controlling unit may just switch the waiting time as target in accordance with the difference in surface area of the charging devices. This results in configuring time appropriately.

Figure 8:
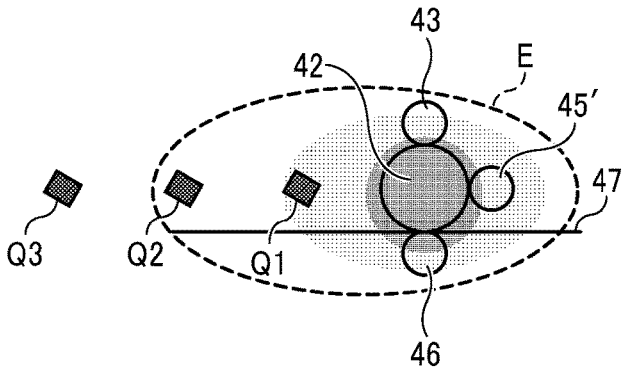
FIG. 8 is a schematic diagram illustrating layout of temperature/humidity sensors against temperature distribution area in performing printing operation around the charging device and a surrounding device in the controlling circuit in FIG. 4.

FIG. 8 is a schematic diagram illustrating layout patterns Q1, Q2, and Q3 of temperature/humidity sensors 55 against a heat distribution area E in performing printing operation around the charging device and a surrounding device in the controlling circuit described above.

With reference to FIG. 8, here, the charging devices indicate the charging roller 43 and the photoconductor 42 described above, and the surrounding devices indicate the intermediate belt 47, a developing device 45' in the developing unit 45, and the primary transfer roller 46. If the machine operates such as performing printing etc., the surrounding devices that contact the charging devices also get warm, and the heat distribution area E appears. In the heat distribution area E, as colored in density with an almost central focus on the photoconductor 42, temperature becomes lower as distance becomes longer. In the distribution pattern Q1, the temperature/humidity sensors 55 are located within a medium temperature area a bit away from a high temperature area around the charging devices. In the distribution pattern Q2, the temperature/humidity sensors 55 are located within a low temperature area away from the medium temperature area. In the distribution pattern Q3, the temperature/humidity sensors 55 are located far away outside the heat distribution area E. Here, as a distance between the temperature/humidity sensor 55 to be used and the charging devices becomes longer, it is considered that difference among temperature/humidity sensors 55 become alienated when the apparatus operates. As a result, the CPU 51 as the controlling unit may select the sensor among multiple temperature/humidity sensors 55 locate inside the apparatus itself corresponding to the most appropriate waiting time based on spots where the temperature/humidity sensors 55 are located and measurement data of the target to be measured. More specifically, the CPU 51 as the controlling unit may switch the waiting time in accordance with difference in distances from the spot where the target whose temperature is to be measured by the temperature/humidity sensor 55 is located to the spot located around the photoconductor 42, and the most appropriate time can be configured. Otherwise, similar effect may be achieved if the CPU 51 switches the waiting time in accordance with difference in distances from the spot where the target whose temperature is to be measured is located inside the apparatus itself regarding the temperature/humidity sensors 55 to the spot located around the photoconductor 42.

Table 5 illustrates calculated waiting time after printing one sheet in accordance with the layout patterns of the temperature/humidity sensors 55 Q1, Q2, and Q3.

TABLE 5

| Sensor position | Waiting time after printing one sheet |
|---|---|
| Position Q1 | 11 minutes |
| Position Q2 | 17.2 minutes |
| Position Q3 | 14.6 minutes |

With reference to Table 5, the waiting time after printing one sheet becomes shorter in order of layout pattern of the temperature/humidity sensors 55 Q1 whose distance from the photoconductor 42 is the shortest, layout pattern Q2, and layout pattern Q3. In other words, the waiting time after printing one sheet becomes longer in order of layout pattern of the temperature/humidity sensors 55 Q3 whose distance from the photoconductor 42 is the longest, layout pattern Q2, and layout pattern Q1. Here, it may be also assumed that other devices are located around the temperature/humidity sensors 55 described above. In this case, not only just the difference in distances, but also the CPU 51 may switch the waiting time in accordance with configuration of layout from the spot where the temperature/humidity sensor 55 is located to the spot around the photoconductor 42 in a broad sense.

Figure 9:
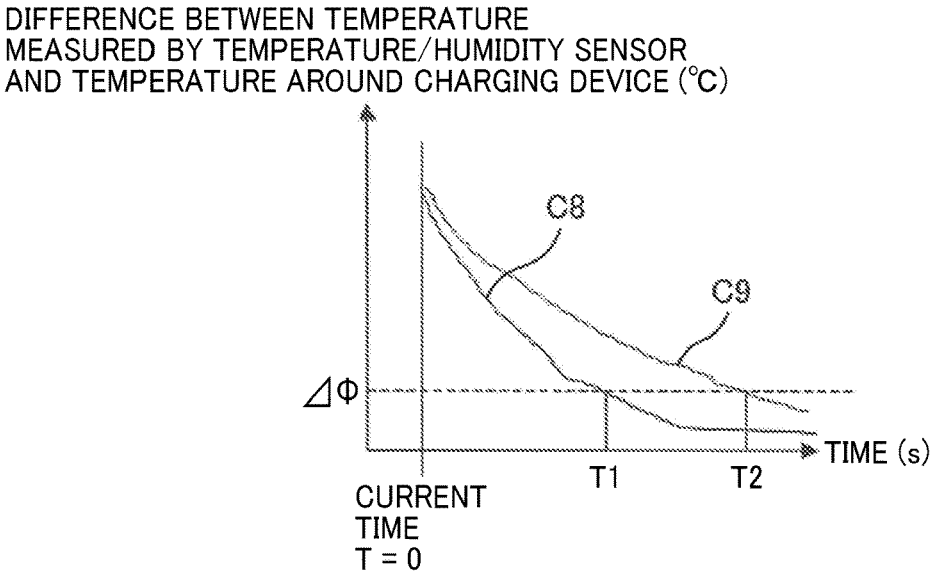
FIG. 9 is a diagram illustrating change of characteristic due to difference in charging methods used by the charging device in the controlling circuit in FIG. 4 in relationship to difference between temperature measured by the temperature/humidity sensor and temperature around the charging device as time passes.

FIG. 9 is a diagram illustrating change of characteristic due to difference in charging methods used by the charging device in the controlling circuit described above in relationship to difference between temperature (OC) measured by the temperature/humidity sensor 55 and temperature around the charging devices as time (s) passes. Here, similarly in FIG. 9, time until difference between temperature detected by the temperature/humidity sensor 55 and temperature around the charging devices becomes equal to or less than a target value $\Delta\varphi$ is considered as the waiting time as the target.

With reference to FIG. 9, as illustrated in characteristic C8 of noncontact charging method that the photoconductor 42 does not contact the charging roller 43 and characteristic C9 of contact charging method that the photoconductor 42 contacts the charging roller 43, even if the charging devices consist of same material and thermal capacity is the same, the required waiting time varies depending on the charging methods. The reason why the required waiting time varies depending on the charging methods is that transferred amount of heat is different among the devices varies, consequently the required waiting time varies. In case of characteristic C9 of contact charging method after current time T=0, since the photoconductor 42 contacts the charging roller 43, it is easy to radiate heat, and the waiting time as target T1 is shorter compared to the waiting time as target T2 of the characteristic C8 of noncontact charging method. Therefore, the CPU 51 as the controlling unit may just switch the waiting time in accordance with the difference in charging methods (in other words, they can be referred to as image forming methods). This results in configuring time appropriately.

Here, internal temperature of the image forming apparatus 1 rises because of energizing power along with the apparatus operation such as printing etc. and physical friction etc. The amount of heat generated in the apparatus may be estimated preliminarily. Therefore, the waiting time as target can be updated with a high degree of accuracy by adding amount of heat generated for each operation of the apparatus. For example, in case of printing one sheet or printing two sheets, the number of rising operation of the image forming apparatus 1 is one and the number of falling operation of the image forming apparatus 1 is one respectively. Therefore, even if the number of printed sheets is doubled, it is not always true that the required waiting time is doubled. In addition, even if the number of printed sheets is the same, since amount of power applied to the photoconductor 42 is different depending on the paper type, the amount of generated heat also varies. Furthermore, since the photoconductor used also varies depending on color printing or monochrome printing, effect of heat received from surroundings varies.

Figure 10:
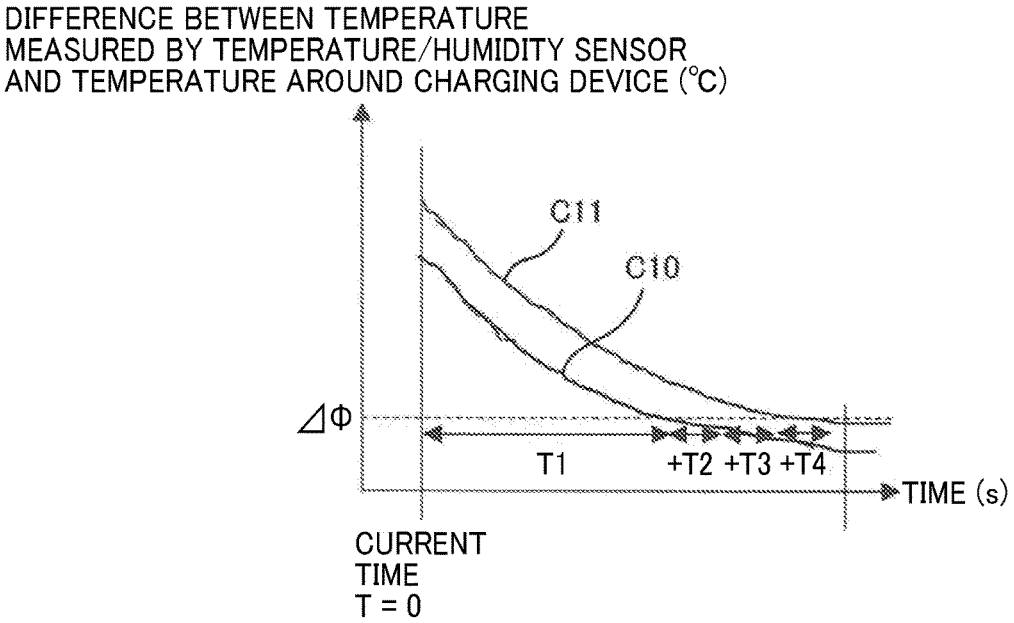
FIG. 10 is a diagram illustrating change of characteristic in printing multiple sheets by the image forming apparatus in FIG. 1 in relationship to difference between temperature measured by the temperature/humidity sensor and temperature around the charging device as time passes.

FIG. 10 is a diagram illustrating change of characteristic in printing multiple sheets by the image forming apparatus 1 described above in relationship to difference (° C.) between temperature measured by the temperature/humidity sensor 55 and temperature around the charging device as time passes (s). Here, similarly in FIG. 10, time until difference between temperature detected by the temperature/humidity sensor 55 and temperature around the charging devices becomes equal to or less than a target value $\Delta\varphi$ is considered as the waiting time as the target.

With reference to FIG. 10, regarding characteristic C10 of printing the first sheet after current time T=0, compared to characteristic C11 of printing the fourth sheet after current time T=0, difference between temperature measured by the temperature/humidity sensor 55 and the temperature around the charging devices is smaller. In addition, regarding the waiting time for printing the first sheet T1, it is shorter compared to the waiting time of printing the fourth sheet, total time of adding additional waiting time+T2, +T3, and +T4. Here, the waiting time of printing the second sheet corresponds to T1+T2, the waiting time of printing the third sheet corresponds to T1+T2+T3, and the waiting time of printing the fourth sheet corresponds to T1+T2+T3+T4. It should be noted that the additional waiting time+T2, +T3, and +T4 are configured as almost equal values. However, the additional waiting time+T2, +T3, and +T4 are configured as values considerably short compared to the waiting time of printing the first sheet T1.

Table 6 illustrates configurations of waiting time in case of printing multiple sheets and modifying paper types, color printing, and monochrome printing.

TABLE 6

| | | Waiting time after printing first sheet | Additional waiting time after printing second sheet |
|---|---|---|---|
| Monochrome | Standard paper | 8 minutes | 4 minutes |
| | Thick paper | 11.5 minutes | 6.5 minutes |
| Color | Standard paper | 12.1 minutes | 7.1 minutes |
| | Thick paper | 15.4 minutes | 9.4 minutes |

With reference to Table 6, regarding the waiting time of printing the first sheet, printing thick paper is longer compared to printing standard paper in printing both monochrome and color. Regarding the additional waiting time of printing the second sheet and so on, likewise, printing thick paper is longer compared to printing standard paper in printing both monochrome and color, and printing color is longer compared to printing monochrome. Therefore, the CPU 51 as the controlling unit may just switch the waiting time in accordance with the number of sheets as the recording medium, paper type, and the type of image data (monochrome or color). This results in configuring time appropriately.

Other than that, in using the charging devices in the image forming apparatus 1 as time passes, sometimes impure substance sticks to the surface of the material that constructs the charging devices or the material itself changes its nature. As a result, thermal conductivity of the material may vary. To cope with this issue, by changing the waiting time in consideration of the change of the thermal conductivity etc. by using the charging devices in the image forming apparatus 1 as time passes, this results in configuring time appropriately.

Table 7 illustrates the change of the thermal conductivity after using the charging devices in the image forming apparatus 1 as time passes.

TABLE 7

| Number of printed sheets | Heat conductivity [W/(m · K)] | Waiting time after printing one sheet |
|---|---|---|
| 0k | 0.361 | 9.7 minutes |
| 100k | 0.329 | 13.2 minutes |
| 400k | 0.264 | 17.0 minutes |

With reference to Table 7, as the number of printed sheets increases, the thermal conductivity decreases and the waiting time after printing one sheet become longer. Therefore, the CPU 51 as the controlling unit may just switch the waiting time in accordance with the change of the heat conductivity by using the charging devices as time passes. This results in configuring time appropriately.

Furthermore, due to light electric charge removing using the electric charge removing unit 48 in forming an image by the image forming apparatus 1 or light-induced fatigue and electrostatic fatigue by applying high voltage using the high-voltage power supply 41 for a long time, a capacity component of the photoconductor 42 varies temporarily. Under the condition described above, in case of detecting film thickness on the surface of the photoconductor 42, even if it is assumed that environmental temperature and humidity are correctly acquired by using the temperature/humidity sensor 55, an error occurs in detecting film thickness. As a result, by configuring the waiting time in consideration of not only the waiting time of temperature/humidity but also recovery time of the light-induced fatigue and the electrostatic fatigue, precision of detecting film thickness can be improved. Here, light-induced fatigue is related to amount of irradiated light written to draw a latent image and amount of light removing electric charge, and electrostatic fatigue is related to strength of applied high voltage and time that the high voltage is applied.

Table 8 illustrates waiting time in consideration of electrostatic fatigue in addition to the temperature and humidity measured by the temperature/humidity sensor 55 until the film thickness on the surface of the photoconductor 42 is detected for each print mode.

TABLE 8

| | | Waiting time after printing first sheet | | Additional waiting time after printing second sheet | |
|---|---|---|---|---|---|
| | | Temperature/humidity | Electrostatic fatigue | Temperature/humidity | Electrostatic fatigue |
| Monochrome | Standard paper | 8 minutes | 7.2 minutes | 4 minutes | 3.6 minutes |
| | Thick paper | 11.5 minutes | 13.1 minutes | 6.5 minutes | 7.3 minutes |
| Color | Standard paper | 12.1 minutes | 10.5 minutes | 7.1 minutes | 6.5 minutes |
| | Thick paper | 15.4 minutes | 16.4 minutes | 9.4 minutes | 11.8 minutes |

With reference to Table 8, regarding the waiting time of printing the first sheet, for both the temperature/humidity and electrostatic fatigue, printing thick paper is longer compared to printing standard paper in printing both monochrome and color. Regarding the additional waiting time of printing the second sheet and so on, likewise, for both the temperature/humidity and electrostatic fatigue, printing thick paper is longer compared to printing standard paper in printing both monochrome and color, and printing color is longer compared to printing monochrome. Therefore, the CPU 51 as the controlling unit may configure the waiting time in consideration of the recovery time of electrostatic fatigue related to the strength of the high voltage applied by supplying power by the high-voltage power supply 41 and the applied time. This results in configuring time appropriately. For example, in printing three sheets of thick paper in color, the waiting time of temperature/humidity becomes 34.2 minutes, and the recovery time of electrostatic fatigue becomes 40 minutes. Consequently, in order to detect film thickness with a high degree of accuracy, it is required to set the waiting time to 40 minutes.

Table 9 illustrates waiting time in consideration of light-induced fatigue in addition to the temperature and humidity measured by the temperature/humidity sensor 55 until the film thickness on the surface of the photoconductor 42 is detected for each print image.

TABLE 9

| | Waiting time after printing first sheet | | Additional waiting time after printing second sheet | |
|---|---|---|---|---|
| | Temperature/humidity | Light-induced fatigue | Temperature/humidity | Light-induced fatigue |
| Text | 8 minutes | 4.1 minutes | 4 minutes | 3.6 minutes |
| Halftone | 9.7 minutes | 8.4 minutes | 6.5 minutes | 7.3 minutes |
| Text-photo | 10.3 minutes | 10.6 minutes | 7.1 minutes | 6.5 minutes |
| Solid image | 13.2 minutes | 15.6 minutes | 9.4 minutes | 11.8 minutes |

With reference to Table 9, waiting time in printing the first sheet of paper varies depending on a time of a printed image. In case of text and halftone, temperature/humidity is longer than light-induced fatigue, and in case of text-photo and solid images, light-induced fatigue is longer than temperature/humidity. Likewise, regarding waiting time in printing the second sheet of paper and so on, in case of text and text-photo, temperature/humidity is longer than light-induced fatigue, and in case of halftone and solid images, light-induced fatigue is longer than temperature/humidity. Therefore, the CPU 51 as the controlling unit may configure the waiting time in consideration of the recovery time of the light-induced fatigue related to amount of irradiated light written to draw a latent image and amount of light removing electric charge. This results in configuring time appropriately. Generally, the recovery time of light-induced fatigue becomes longer as the amount of irradiated light increases. Therefore, the recovery time of light-induced fatigue becomes longer in printing solid images with much irradiated amount of light. For example, waiting time indicating recovery time of light-induced fatigue required to detect film thickness in case of printing solid images becomes 15.6 minutes.

Theoretically, waiting time required that temperature/humidity around the temperature/humidity sensor 55 corresponds to temperature/humidity of the charging devices is infinite time. Realistically, it is impossible to leave devices for infinite time. Therefore, it is required to configure time using a certain finite period of time. In this case, as the waiting time is set shorter, accuracy of temperature/humidity becomes lower, and as the waiting time is set longer, accuracy of temperature/humidity becomes higher. As a result, as the waiting time required for required accuracy, this results in configuring time appropriately by using difference (deviation) between a value of temperature/humidity measured by the temperature/humidity sensor 55 and a value of temperature/humidity of the charging devices arbitrarily depending on a condition.

Table 10 specifically illustrates difference of waiting time depending on accuracy of detecting film thickness in accordance with error in detecting film thickness, a target value $\Delta\varphi$, and waiting time after printing one sheet.

TABLE 10

| Error in detecting film thickness | $\Delta\phi$ | Waiting time after printing one sheet |
|---|---|---|
| 2% | ±0.2° C. | 35 minutes |
| 5% | ±1.0° C. | 21 minutes |
| 10% | ±1.4° C. | 13 minutes |

With reference to Table 10, in case the error in detecting film thickness is 2%, the target value $\Delta\phi$ corresponds to ±0.2° C., and the waiting time after printing one sheet corresponds to 35 minutes. In addition, in case the error in detecting film thickness is 5%, the target value $\Delta\varphi$ corresponds to +1.0° C., and the waiting time after printing one sheet corresponds to 21 minutes. Furthermore, in case the error in detecting film thickness is 10%, the target value $\Delta\varphi$ corresponds to ±1.4° C., and the waiting time after printing one sheet corresponds to 13 minutes. As illustrated in Table 10, this results in configuring time appropriately in accordance with the required accuracy in detecting film thickness. Therefore, the CPU 51 as the controlling unit may switch the difference value of the waiting time in accordance with the accuracy of detecting film thickness on the surface of the photoconductor 42. As a result, the accuracy of detecting film thickness can be improved.

Here, in this embodiment, it is required to use an output voltage value and an output current value of the high-voltage power supply 41 to detect film thickness on the surface of the photoconductor 42. Therefore, it is required that the power supply for the main unit of the image forming apparatus 1 is turned on. However, in counting the waiting time, it is not always required that the power supply in the main unit of the image forming apparatus 1 is turned on. For example, as described before with reference to FIG. 4, the waiting time can be counted continuously using the timer 54 etc. connected to the controller 52 etc. including a battery etc. In addition, in order to detect film thickness on the surface of the photoconductor 42 in this embodiment, a known technology that uses output voltage and output current of the high-voltage power supply 41 that applies high voltage to the photoconductor 42 and environmental temperature/humidity information of the temperature/humidity sensor 55 may be applied. Here, after confirming that time to correct has arrived and applying multiple predetermined charging voltage to the charging devices, charging current at the time of applying each charging voltage is detected. Subsequently, after calculating current (I)-voltage (V) characteristic and detecting film thickness on the surface of the photoconductor 42, temperature and humidity are acquired from the temperature/humidity sensor 55, and the film thickness is corrected based on the acquired temperature and humidity. Lastly, voltage is determined in accordance with the corrected film thickness, the determined voltage is regarded as charging voltage and applied to the charging devices from the high-voltage power supply 41. Here, the method of controlling electric power of the high-voltage power supply 41 may be considered in various ways, and other method may be applied. Therefore, the method of controlling electric power of the high-voltage power supply 41 is not limited particularly.

Figure 11:
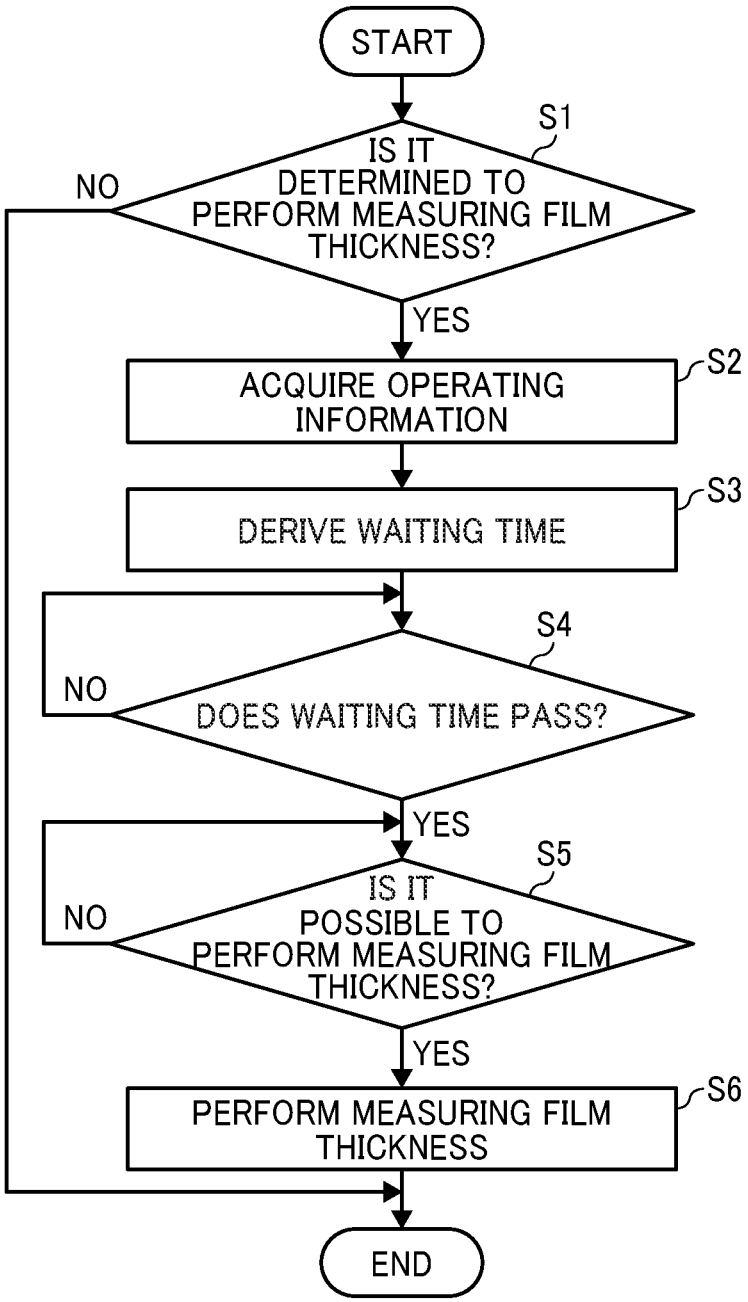
FIG. 11 is a flowchart illustrating an operation of basic control by the controlling circuit in FIG. 4.

FIG. 11 is a flowchart illustrating an operation of basic control by the controlling circuit illustrated in FIG. 4. In the operation of basic control by the controlling circuit, first, the CPU 51 determines whether or not it is determined to detect film thickness on the surface of the photoconductor 42 in S1. After the determination, if it is not determined to detect film thickness, the operation ends as is. By contrast, if it is determined to detect film thickness, operating information such as machine operating information etc. of the image forming apparatus 1 is acquired in S2. In acquiring the operating information, it is also possible to acquire past operating information. Subsequently, the waiting time is derived in S3 to configure the waiting time corresponding to the predetermined time. Furthermore, it is determined whether or not the waiting time elapses in S4. After the determination, if the waiting time does not elapse, the operation goes back to the determination and the operation is repeated until the waiting time elapses. By contrast, if the waiting time elapses, consecutively, it is determined whether or not the film thickness on the surface of the photoconductor 42 can be detected in S5. After the determination, if it is not possible to detect film thickness, the operation goes back to the determination and the operation is repeated until the film thickness can be detected. By contrast, if the film thickness can be detected, the operations ends after detecting film thickness in S6.

Here, in the operation of basic control illustrated in FIG. 11, if a new request to operate machine arrives while the determination on whether or not the waiting time elapses is counted in S4, it is impossible to accept the new request to operate machine. To cope with this issue, an operation requesting adaptive control that adds waiting time to the new request to operate machine accepted in midflow is performed.

Figure 12:
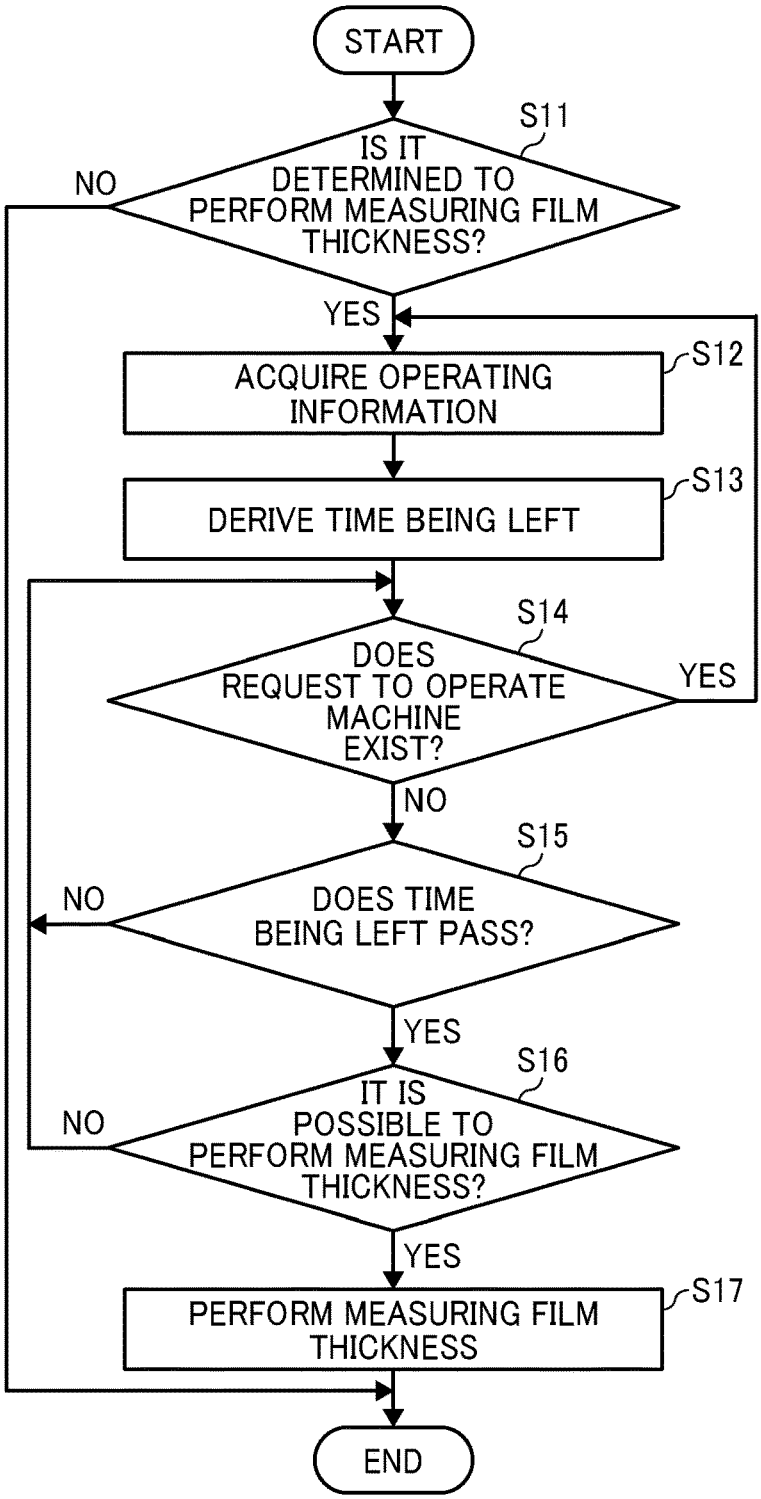
FIG. 12 is a flowchart illustrating an operation of operation requesting adaptive control by the controlling circuit in FIG. 4.

FIG. 12 is a flowchart illustrating an operation of operation requesting adaptive control by the controlling circuit in FIG. 4. In the operation requesting adaptive control by the controlling circuit, first, the CPU 51 determines whether or not it is determined to detect film thickness on the surface of the photoconductor 42 in S11. After the determination, if it is not determined to detect film thickness, the operation ends as is. By contrast, if it is determined to detect film thickness, operating information such as machine operating information etc. of the image forming apparatus 1 is acquired in S12. In acquiring the operating information for the first time, it is also possible to acquire past operating information. Subsequently, the waiting time is derived in S13 to configure the waiting time corresponding to the predetermined time. Furthermore, after that, it is determined whether or not the request to operate machine such as printing etc. exists in S14. After the determination, if the request to operate machine exists, the operation goes back to step S12 that acquires the operating information, and the subsequent steps are repeated. As a result, the waiting time can be added to the new request to operate machine accepted in midflow.

By contrast, if the request to operate machine does not exist, consecutively, it is determined whether or not the waiting time elapses in S15. After the determination, if the waiting time does not elapse, the operation goes back to the determination that determines whether or not the request to operate machine exists in S14 and the subsequent operation is repeated. By contrast, if the waiting time elapses, consecutively, it is determined whether or not the film thickness on the surface of the photoconductor 42 can be detected in S16. After the determination, if it is not possible to detect film thickness, the operation goes back to the determination that determines whether or not the request to operate machine exists in S14 and the subsequent operation is repeated. By contrast, if the film thickness can be detected, the operations ends after detecting film thickness in S17. As described above, by adding the waiting time to the request to operate machine newly accepted in midflow, the film thickness on the surface of the photoconductor 42 can be detected in a condition that does not exist in user status of use without providing waiting time to the user. In addition, in acquiring the operating information for the first time, it is also possible to acquire the past operating information.

Figure 13:
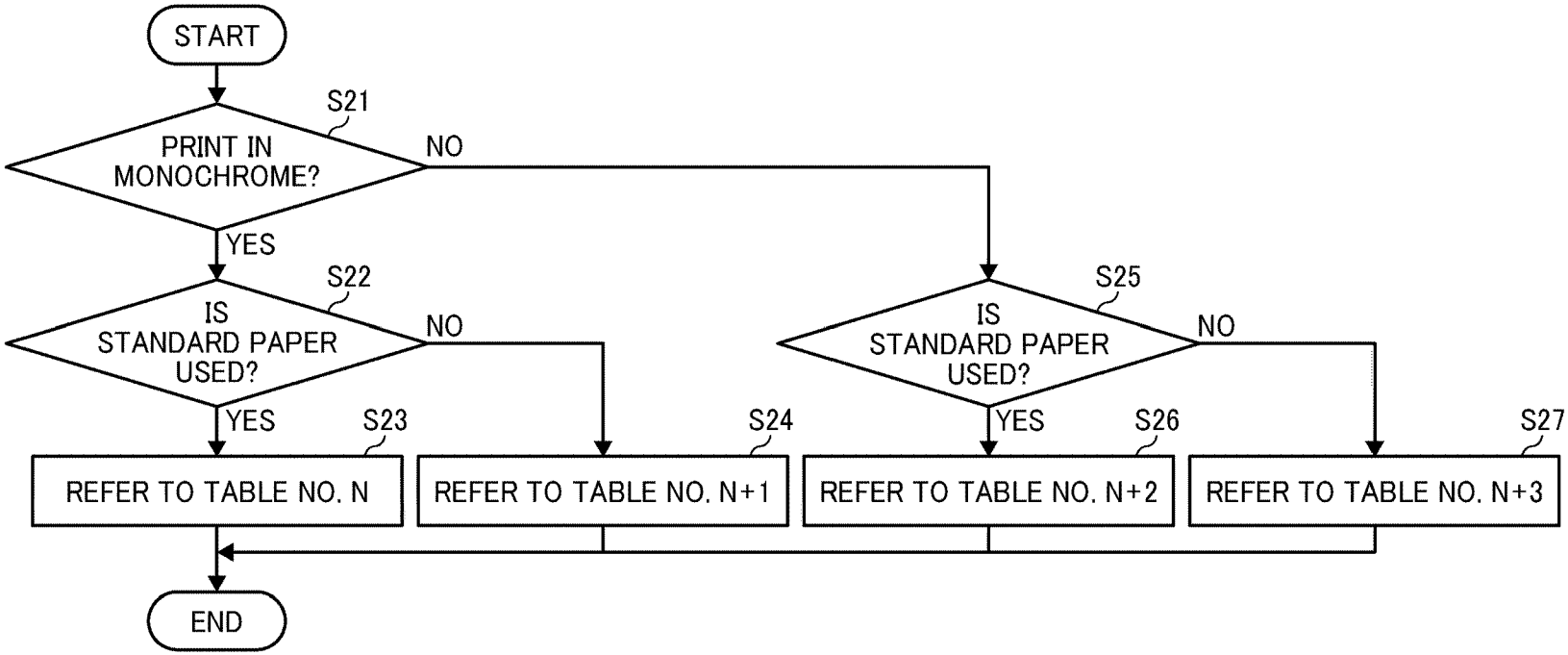
FIG. 13 is a flowchart illustrating an operation of performing an operation of deriving waiting time included in the basic control in FIG. 11 or in the operation requesting adaptive control in FIG. 12 in accordance with a printing mode in detail.

FIG. 13 is a flowchart illustrating an operation of performing an operation of deriving waiting time included in the basic control in FIG. 11 or in the operation requesting adaptive control in FIG. 12 in accordance with a printing mode in detail. Here, in this case, waiting time is preliminarily stored in the memory 53 in the form of multiple tables in accordance with a type of printing paper used for each printing mode.

With reference to FIG. 13, after starting deriving waiting time, first, it is determined whether or not printing is performed in monochrome mode in S21. After the determination, in case of monochrome printing, consecutively, it is determined whether or not the printing paper is standard paper in S22. After the determination, in case of standard paper, with reference to table number N in S23, corresponding waiting time is acquired, and it is finished to derive the waiting time. By contrast, if the printing paper is not standard paper, with reference to table number N+1 in S23, corresponding waiting time is acquired, and it is finished to derive the waiting time. In addition, after the determination on whether or not printing is performed in monochrome mode in S21, if printing is not performed in monochrome mode (i.e., printing is performed in color mode), consecutively, it is determined whether or not the printing paper is standard paper similarly in S25. After the determination, in case of standard paper, with reference to table number N+2 in S26, corresponding waiting time is acquired, and it is finished to derive the waiting time. By contrast, if the printing paper is not standard paper (i.e., the printing paper is thick paper), with reference to table number N+3 in S27, corresponding waiting time is acquired, and it is finished to derive the waiting time. It should be noted that, in FIG. 13, the case that the waiting time configured in accordance with the type of printing paper used for each printing mode is switched is described. However, as described before, other various conditions may be applied.

Here, the technology regarding the image forming apparatus 1 in this embodiment described above may also be considered as a method of controlling the image forming apparatus 1. The method of controlling includes steps of supplying high-voltage power for charging by the high-voltage power supply 41, charging the charging device (the charging roller 43) by supplying the power, and regarding the photoconductor 42 as an image forming medium as a target to be charged. In addition, the method of controlling includes steps of controlling supplying power using the signal commanding a power value transferred from the controlling unit (the CPU 51) to the power supply based on the power value feedback signal, and counting the elapsed time by using the timer 54. Furthermore, the method of controlling includes a step of storing the waiting time as the target based on the elapsed time being counted by the storing unit (the memory 53). Lastly, the method of controlling includes a step of detecting temperature inside the apparatus itself away from the photoconductor 42 and detecting humidity inside the apparatus itself away from the photoconductor 42. It is premised that the method of controlling includes the steps described above.

In addition, in the controlling step, after acquiring the elapsed time being counted from the timer 54, the waiting time indicating time that difference between the temperature being detected in the apparatus and temperature around the photoconductor 42 estimated preliminarily becomes equal to or less than a predetermined value required to ensure accuracy detecting the film thickness on the surface of the photoconductor 42 is calculated. Otherwise, it is also possible that the waiting time indicating time that difference between the humidity being detected in the apparatus and humidity around the photoconductor 42 estimated preliminarily becomes equal to or less than a predetermined value required to ensure accuracy detecting the film thickness on the surface of the photoconductor 42 is calculated. After determining at least either one of the waiting time calculated as described above as the waiting time as target and stored in the memory, the film thickness on the surface of the photoconductor 42 is detected after the waiting time elapses.

In controlling supplying power, it is preferable to switch the waiting time in accordance with at least any one of the difference in thermal conductivity of the material of the charging devices (charging roller 43) or the photoconductor 42, the difference in thermal capacity of the material of the charging devices (charging roller 43) or the photoconductor 42, and the difference in the surface area of the material of the charging devices (charging roller 43) or the photoconductor 42. In addition, in controlling supplying power, it is preferable to switch the waiting time in accordance with the difference in distance from a point where the temperature sensor whose temperature is to be measured is located inside the apparatus itself to a point around the photoconductor where the temperature sensor is located. Otherwise, the waiting time can be switched in accordance with the difference in distance from a point where the humidity sensor whose humidity is to be measured is located inside the apparatus itself to a point around the photoconductor 42 where the humidity sensor is located. Other than that, the waiting time can be switched in accordance with a configuration of layout regarding those distances.

On the other hand, in controlling supplying power, it is preferable to switch the waiting time in accordance with at least any one of the difference in charging methods, the number of recording medium sheets (recording media) that images are to be formed, the type of the recording medium, and the type of image data for forming an image on the recording medium. Other than that, the waiting time can be switched in accordance with the variation of thermal conductivity after using the charging device (the charging roller 43) or the photoconductor 42 as time passes.

On the other hand, in controlling supplying power, it is preferable to configure the waiting time in consideration of either the recovery time of electrostatic fatigue related to strength of the high voltage and applied time of the high voltage applied by supplying power or the recovery time of the light-induced fatigue related to amount of irradiated light written to draw a latent image and amount of light removing electric charge. Other than that, in controlling supplying power, it is preferable to switch the difference value of the waiting time in accordance with the accuracy in detecting the film thickness on the surface of the photoconductor 42.

Even if the temperature/humidity sensor 55 is separated from the photoconductor 42, by configuring the appropriate waiting time, the embodiment described above provides the image forming apparatus that may detect the film thickness on the surface of the photoconductor 42 with a high degree of accuracy at low cost, saving space.

Note that the above-described embodiments are examples of embodiments of the claimed invention, and the embodiments of the claimed invention are not limited to the above-described embodiments. The above-described embodiments can be variously modified within the scope of the claimed invention.

The present invention also encompasses a non-transitory recording medium storing a program that executes an image forming control method, performed by the image forming apparatus. The image forming control method, performed by the image forming apparatus, includes the steps of supplying high-voltage electric power for charging, being charged by the electric power supplied from a high-voltage power supply, carrying an image to be formed on a recording medium, with the electric power supplied from a charging device, detecting temperature inside the image forming apparatus, detecting humidity inside the image forming apparatus, outputting a signal for commanding an electric power value to the high-voltage power supply to cause the high-voltage power supply to supply the electric power with the electric power value, and control supply of the electric power based on an electric power value feedback signal from the high-voltage power supply, obtaining a temperature difference between the detected temperature and an estimated temperature, obtaining a humidity difference between the detected humidity and an estimated humidity, obtaining at least one of a time it requires for the temperature difference becomes equal to or less than a predetermined value, and one of a time it requires for the humidity difference becomes equal to or less than a predetermined value, as a waiting time, storing the waiting time in a memory, and detecting film thickness on a surface of a photoconductor after the target waiting time elapses.

For example, elements and/or features of different illustrative embodiments may be combined with each other and/or substituted for each other within the scope of this disclosure and appended claims.

It should be noted that the case that the computer apparatus reads and executes the program code is just one example to implement the functional units in the embodiments described above. In addition, in accordance with instructions by the program code, an operating system (OS) running on the computer apparatus may perform a part of the operations or all operations. Furthermore, the functional units described in the above embodiments may obviously be implemented by performing those operations.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, workstation) may control an information processing apparatus or an image processing apparatus such as image forming apparatus using a computer-readable program, which can execute the above-described processes or steps. In the above-described embodiments, at least one or more of the units of apparatus can be implemented as hardware or as a combination of hardware/software combination. The computer software can be provided to the programmable device using any storage medium or carrier medium for storing processor-readable code such as a floppy disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, a hard disk in a server, a solid state memory device or the like, but not limited these.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

a high-voltage power supply to supply high-voltage electric power for charging;

a charging device to be charged by the electric power supplied from the high-voltage power supply;

a photoconductor to carry an image to be formed on a recording medium, with the electric power supplied from the charging device;

a temperature sensor disposed at a distance from the photoconductor to detect temperature inside the image forming apparatus;

a humidity sensor disposed at a distance from the photoconductor to detect humidity inside the image forming apparatus; and circuitry to output a signal for commanding an electric power value to the high-voltage power supply to cause the high-voltage power supply to supply the electric power with the electric power value, and control supply of the electric power based on an electric power value feedback signal from the high-voltage power supply, the circuitry being configured to obtain a temperature difference between the detected temperature and an estimated temperature, obtain a humidity difference between the detected humidity and an estimated humidity, obtain at least one of a time required for the temperature difference to become equal to or less than a predetermined value, and one of a time required for the humidity difference to become equal to or less than a predetermined value, as a waiting time, store the waiting time in a memory in a table format and a table of the table format includes a plurality of warning times, and detect film thickness on a surface of the photoconductor after a target waiting time elapses.

2. The image forming apparatus according to claim 1, wherein the circuitry adjusts the waiting time in accordance with difference in thermal conductivity of a material of the charging device or a material of the photoconductor.

3. The image forming apparatus according to claim 1, wherein the circuitry adjusts the waiting time in accordance with difference in thermal capacity of a material of the charging device or a material of the photoconductor.

4. The image forming apparatus according to claim 1, wherein the circuitry adjusts the waiting time in accordance with difference in a surface area of a material of the charging device or a material of the photoconductor.

5. The image forming apparatus according to claim 1, wherein the circuitry adjusts the waiting time in accordance with one of: a distance between a location where an object whose temperature is to be measured by the temperature sensor is disposed and a location where the temperature sensor is disposed; and a distance between a location where an object whose humidity is to be measured by the humidity sensor is disposed and a location where the humidity sensor is disposed.

6. The image forming apparatus according to claim 1, wherein the circuitry adjusts the waiting time in accordance with one of: a distance between a location where an object whose temperature is to be measured by the temperature sensor is disposed and a location where the temperature sensor is disposed; and layout between the location where an object whose humidity is to be measured by the humidity sensor is disposed and a location where the humidity sensor is disposed.

7. The image forming apparatus according to claim 1, wherein the circuitry adjusts the waiting time in accordance with difference in a charging method.

8. The image forming apparatus according to claim 1, wherein the circuitry adjusts the waiting time in accordance with a number of sheets of the recording medium to be formed with the image.

9. The image forming apparatus according to claim 1, wherein the circuitry adjusts the waiting time in accordance with a type of the recording medium to be formed with the image.

10. The image forming apparatus according to claim 1, wherein the circuitry adjusts the waiting time in accordance with a type of image data from which the image is generated.

11. The image forming apparatus according to claim 1, wherein the circuitry adjusts the waiting time in accordance with a change in heat conductivity of the charging device or the photoconductor after an elapse of time.

12. The image forming apparatus according to claim 1, wherein the circuitry configures the waiting time further based on recovery time of electrostatic fatigue related to a strength of the high voltage that has been applied and a period of time that the high voltage has been applied.

13. The image forming apparatus according to claim 1, wherein the circuitry configures the waiting time based on recovery time of light-induced fatigue related to an amount of light used for forming a latent image of the image and an amount of light used for removing electric charge.

14. The image forming apparatus according to claim 1, wherein the circuitry changes a difference value of the waiting time in accordance with a desired degree of accuracy for detecting the film thickness on the surface of the photoconductor.

15. A method of controlling an image forming apparatus, the method comprising:

supplying high-voltage electric power for charging;

being charged by the electric power supplied from a high-voltage power supply;

carrying an image to be formed on a recording medium, with the electric power supplied from a charging device;

detecting temperature inside the image forming apparatus;

detecting humidity inside the image forming apparatus;

outputting a signal for commanding an electric power value to the high-voltage power supply to cause the high-voltage power supply to supply the electric power with the electric power value, and control supply of the electric power based on an electric power value feedback signal from the high-voltage power supply;

obtaining a temperature difference between the detected temperature and an estimated temperature;

obtaining a humidity difference between the detected humidity and an estimated humidity;

obtaining at least one of a time required for the temperature difference to become equal to or less than a predetermined value, and one of a time required for the humidity difference to become equal to or less than a predetermined value, as a waiting time;

storing the waiting time in a memory in a table format and a table of the table format includes a plurality of warning times; and detecting film thickness on a surface of a photoconductor after a target waiting time elapses.

16. The method of controlling according to claim 15, the method further comprising:

adjusting the waiting time in accordance with at least any one of difference in thermal conductivity of a material of the charging device or a material of the photoconductor, difference in thermal capacity of a material of the charging device or a material of the photoconductor, and difference in a surface area of a material of the charging device or a material of the photoconductor.

17. The method of controlling according to claim 15, the method further comprising:

adjusting the waiting time in accordance with one of: a distance between a location where an object whose temperature is to be measured by the temperature sensor is disposed and a location where the temperature sensor is disposed; and a distance between a location where an object whose humidity is to be measured by the humidity sensor is disposed and a location where the humidity sensor is disposed, or adjusting the waiting time in accordance with layout regarding the distance.

18. The method of controlling according to claim 15, the method further comprising:

adjusting the waiting time in accordance with at least any one of difference in a charging method, a number of sheets of the recording medium to be formed with the image, a type of the recording medium to be formed with the image, a type of image data from which the image is generated, and a change in heat conductivity of the charging device or the photoconductor after an elapse of time.

19. The method of controlling according to claim 15, the method further comprising:

configuring the waiting time further based on either recovery time of electrostatic fatigue related to a strength of the high voltage that has been applied and a period of time that the high voltage has been applied or recovery time of light-induced fatigue related to an amount of light used for forming a latent image of the image and an amount of light used for removing electric charge.

20. The method of controlling according to claim 15, the method further comprising:

changing a difference value of the waiting time in accordance with a desired degree of accuracy for detecting the film thickness on the surface of the photoconductor.

* * * * *